United States Patent [19]

Masiello et al.

[11] 4,201,354

[45] May 6, 1980

[54] RELOADABLE PAPER DISPENSER

[75] Inventors: Felix R. Masiello, Parsippany; John S. Kula, Budd Lake, both of N.J.

[73] Assignee: AM International, Inc., Los Angeles, Calif.

[21] Appl. No.: 951,223

[22] Filed: Oct. 13, 1978

[51] Int. Cl.[2] ..... G03B 17/26; B65H 17/02

[52] U.S. Cl. ..... 242/71.7; 242/67.3 R

[58] Field of Search ..... 242/71.7, 67.1 R, 67.2, 242/67.3 R

[56] References Cited

U.S. PATENT DOCUMENTS

| | | | |
|---|---|---|---|
| 2,205,052 | 6/1940 | Stein | 242/67.3 R |
| 2,219,722 | 10/1940 | Lloyd | 242/67.3 R |
| 2,239,188 | 4/1941 | Boes | 242/71.7 X |
| 3,586,258 | 6/1971 | Horlezeder | 242/71.7 |
| 3,752,413 | 8/1973 | Caruso | 242/71.7 |

*Primary Examiner*—Edward J. McCarthy
*Attorney, Agent, or Firm*—Robert S. Hulse

[57] ABSTRACT

An enclosure system includes a light-tight enclosure and a means for guiding the direction of movement of phototypesetting paper to and from the enclosure. The enclosure is capable of storing a roll of phototypesetting paper, of dispensing paper from said roll, and of returning paper onto said roll without folding or otherwise buckling the paper. The system obviates the need for a separate "take-up" enclosure and eliminates the problem of degraded print quality typically associated with characters printed at or near a fold. The enclosure comprises a container with a pivotally mounted spring-loaded lid with a gasket thereon, and a shaft disposed in the container for storing a roll of paper of selected width.

13 Claims, 7 Drawing Figures

Fig. 1
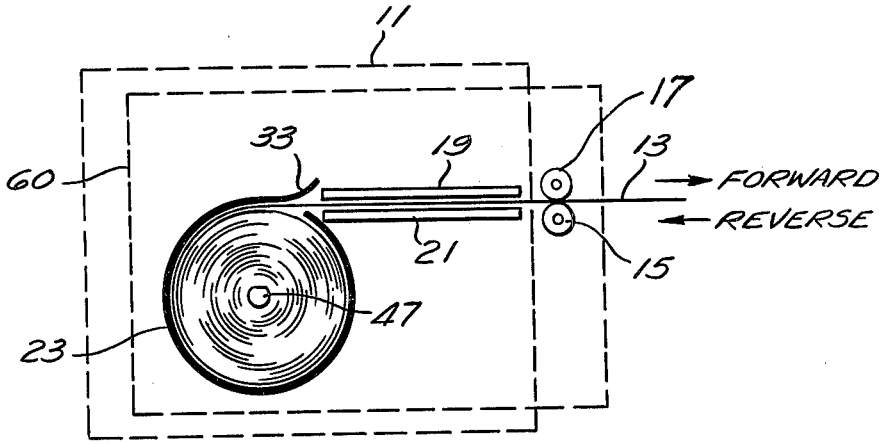
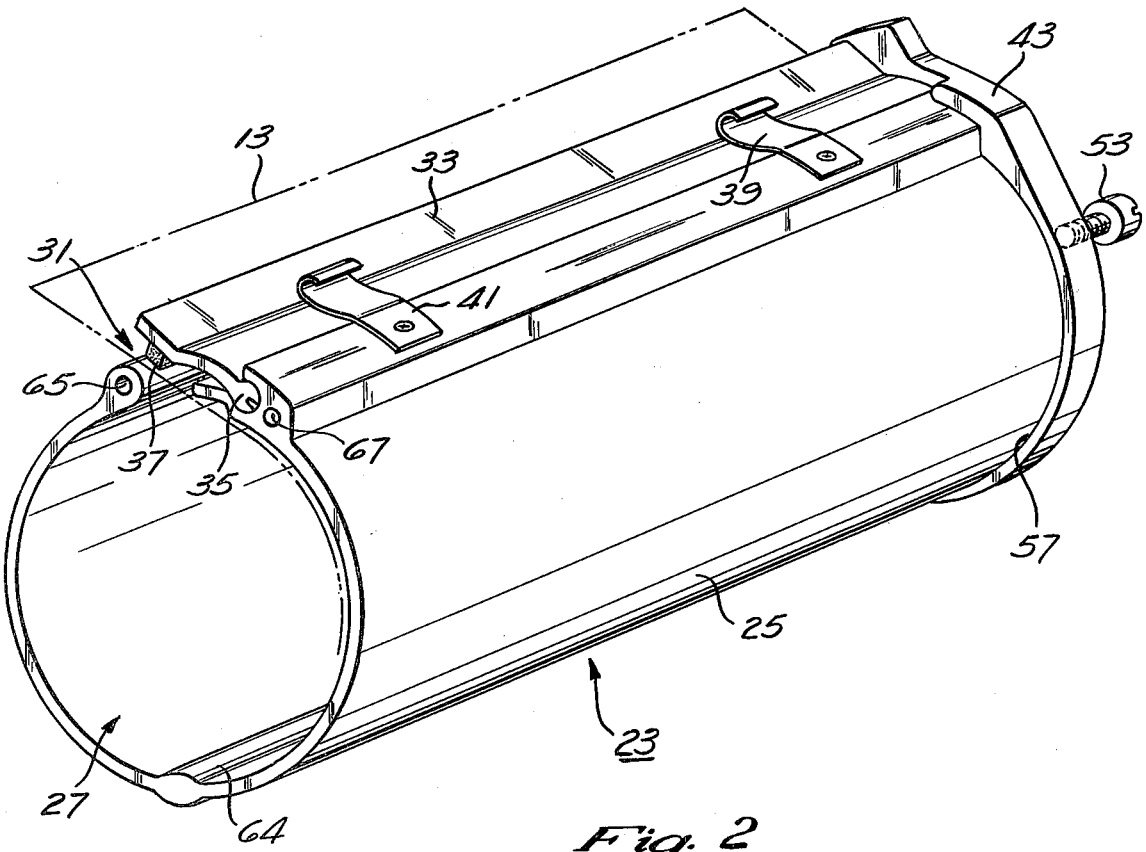
Fig. 2

Fig. 3
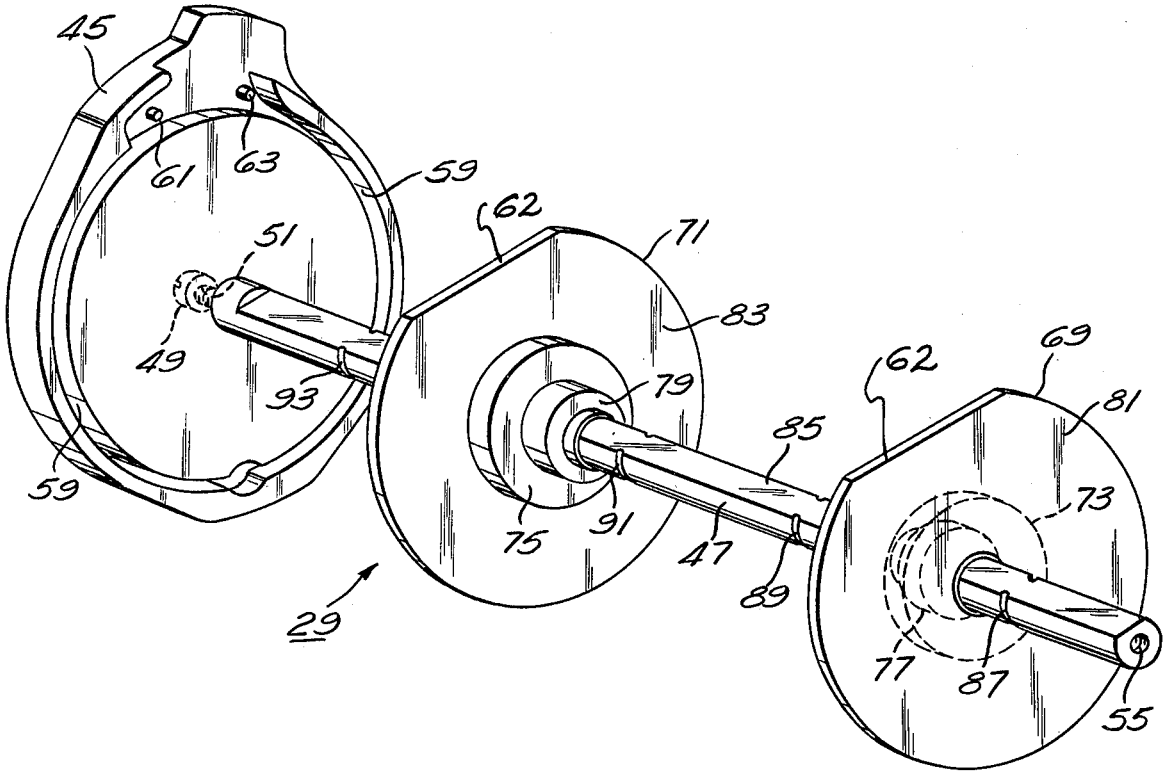
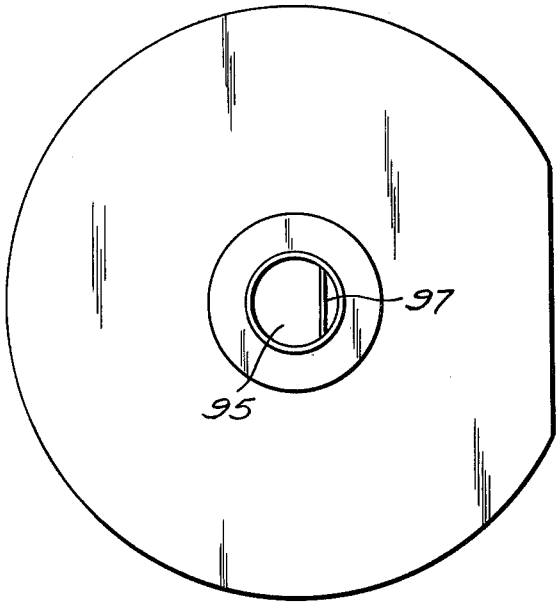
Fig. 4

Fig. 5A
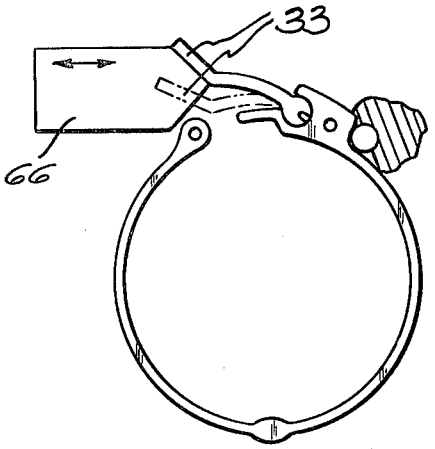
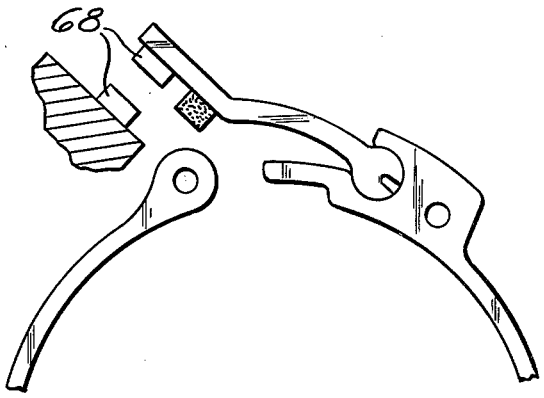
Fig. 5B
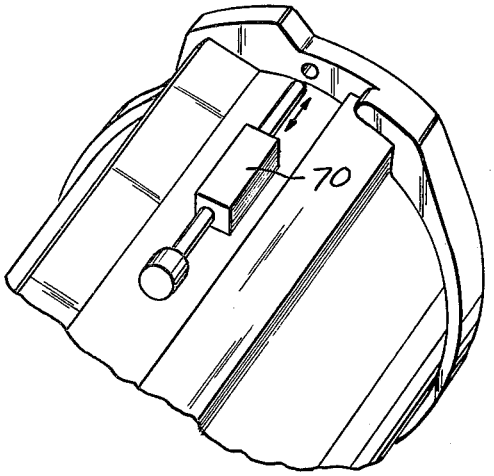
Fig. 5C

RELOADABLE PAPER DISPENSER

BACKGROUND OF THE INVENTION

This invention relates generally to enclosures for receiving and dispensing a web (e.g. take-up and supply boxes for collecting and dispensing paper or film) and, in particular, to light-tight paper-dispensing and paper-receiving enclosures used with phototypesetting systems.

Many prior-art phototypesetting systems utilize two enclosures, one for supplying or dispensing paper to the typesetter from a supply reel contained in the enclosure, and the other for collecting the dispensed paper onto a take-up reel. In certain of these prior-art systems, to be able to produce multi-column copy, it is required that the paper travels in two directions (i.e., in a forward direction from the supply reel to the take-up reel along a prescribed optical path enabling the phototypesetter to produce a column of copy, and in a backward direction from the take-up reel in preparation for production by the phototypesetter of a subsequent column of copy). One such system capable of producing multi-column copy is the Model 1200 Quadritek phototypesetter, manufactured by the Graphic Products Division of Itek Corporation.

Typically in such prior-art phototypesetting systems, the paper becomes folded in accordian-like fashion when its direction of movement is reversed preparatory to producing multi-column copy. This folding of the paper often causes the emulsion that is typically on the surface of such paper to become abraded, resulting in inferior quality of the type produced at or in the region of the fold or abrasion. Furthermore, the accumulation of folded paper often causes non-uniformity in paper tension again degrading the quality of copy produced. What would be desirous and useful, therefore, is an enclosure system that would eliminate the problems of emulsion abrasion and non-uniformity in paper tension, by making paper folding unnecessary when producing multi-column copy.

SUMMARY OF THE INVENTION

In accordance with the illustrated preferred embodiment of the present invention, an enclosure system is described having a light-tight enclosure, and a means (guide plates) for channeling or guiding the path or direction of movement of paper to and from the enclosure. The enclosure is capable of storing a roll of paper, of dispensing paper from said roll, and of returning paper onto said roll without folding or otherwise buckling the paper, the paper being of selected rigidity (e.g. phototypsetting paper) and driven by an external source such as a rotating roller. When driven in a forward direction, paper is dispensed from the enclosure; when driven in a reverse or backward direction, paper accumulates without folds around the roll within the enclosure. The enclosure comprises a container and a shaft disposed in the container for storing a roll of paper of selected width. The container includes a pivotally-mounted spring-loaded lid with a gasket thereon for rendering the enclosure light-tight and permitting the dispensing and accumulation of paper from and in the enclosure, without causing the paper to become folded or otherwise buckled. The ease in which paper is dispensed from or accumulated in the enclosure provides for uniformity in paper tension during said operations. In addition to dispensing paper, the enclosure, by being able to accumulate or store returned paper, obviates the need for a separate "take-up" enclosure.

BRIEF DESCRIPTION OF THE DRAWINGS

FIG. 1 is a cross-sectional view of the system of the present invention.

FIG. 2 is a perspective view of a container portion of an enclosure utilized in the system of FIG. 1.

FIG. 3 is a perspective view of a shaft portion of an enclosure utilizable with the container of FIG. 2.

FIG. 4 is a side view of a hub portion of the shaft of FIG. 3.

FIGS. 5A-5C are side views of a lid affixed to the container of FIG. 2.

DESCRIPTION OF THE PREFERRED EMBODIMENT

Referring now to FIG. 1, there is shown an enclosure system or apparatus 11 for dispensing and receiving a sheet of paper 13 of selected rigidity (e.g., paper typically used in phototypesetters such as the Kodak Grade S stabilization paper manufactured by Eastman-Kodak Corporation, or the model 871 resin-coated phototypesetter paper manufactured by General Photoproducts Company). The paper 13 is pinched between drive roller 15 and pinch roller 17, and is driven by drive roller 15 in either a forward direction to a phototypesetter (not shown) or in a reverse direction from the phototypesetter. Drive roller 15 is connected to a drive motor (not shown). Apparatus 11 includes a pair of parallel guide plates 19, 21 (which may be fabricated from suitable metal or plastic material) and an enclosure 23. Paper 13 travelling to or from enclosure 23 passes between plates 19, 21 which guide the paper therethrough and prevents the paper from folding or buckling. The space or distance between the plates may be adjustable. However, a distance that keeps the plates just short of contact with the paper is preferred.

As shown in FIGS. 2 and 3, enclosure 23 includes a cylindrical outer portion or container 25, forming an elongated chamber 27 therein, and a reel or shaft portion 29, the container having a thin slit or opening 31 running throughout its length through which paper 13 is dispensed or received. Container 25 also includes a spring-loaded door or lid 33 pivotly affixed to the container (along its length thereof) by means of light-baffled pivot 35. A gasket 37, made of suitable opaque light-baffling material such as vinyl-coated polyurethane foam is adhesively affixed to the underside of lid 33 along opening 31. Springs 39, 41 affixed to container 25 acts to lightly press lid 33 and gasket 37 against container 25, thereby forming a light-tight seal along opening 31 of container 25.

Container 25 is provided with a cap 43 attached to one end of the container, and a second cap 45 (FIG. 3) removably attached to the other end of the container. Attached to cap 45 and removable therewith is an axle or shaft 47, the attachment being accomplished, for example, by means of a screw 49 insertable into an end of the shaft through a central opening 51 in cap 45. Likewise, thumb screw 53 (FIG. 2), insertable through a central opening (not shown) in cap 43 and into threaded hole 55 (FIG. 3) of shaft 47 serves to affix cap 43 to the shaft 47, and to container 25. Grooves 57 and 59 located on the inner surfaces of caps 43 (FIG. 2) and 45 (FIG. 3) serve to engage the edges or wall of the container and center or properly position the caps 43, 45 with respect to said edges or wall.

A roll of paper is insertable onto shaft 47. One end of the paper extends through opening 31 and guide plates 19, 21 and placed between rollers 15, 17, as shown in FIG. 1. The action of drive roller 15 in moving the paper in a forward direction causes the paper to unroll from shaft 47. To enable the phototypesetter to produce multi-column copy, roller 15 is made to rotate in an opposite direction causing the direction of movement of paper 13 to be reversed. Unlike prior-art devices which cause the paper to fold when reversed, the folding occurring typically at the opening of the dispensing or supply box, enclosure 23 operating in conjunction with guide plates 19, 21 causes the paper 13, when its direction of movement is reversed, not to fold or buckle but to travel under gasket 37 of lid 33 and through opening 31, and to loosely re-accumulate about shaft 47 in the enclosure as shown in FIG. 1. Springs 39 and 41 are preselected and disposed in a manner, as shown in FIG. 2, which enables pivotally mounted lid 33 and gasket 37 to engage, and apply a selected pressure upon, an outer surface of the enclosure sufficient to maintain the light-tightness of the enclosure 23 when said enclosure is removed from its light-tight environment (the boundaries of which environment is depicted by reference numeral 60, such light-tight environment being typical of phototypesetting systems such as the Quadritek System mentioned hereinbefore) to a non-light-tight environment for reloading of paper. When in its light-tight environment, lid 33 is maintained slightly ajar thereby permitting the reverse or backward passage of the paper 13 under the lid and gasket and into the enclosure. In many prior-art paper dispensers, not only is it difficult to push back (for example by means of a roller) previously-dispensed paper into the dispenser, but it is often virtually impossible to push back such paper into a light-tight container (sealed with a lid and gasket as disclosed herein) without causing the paper to fold or buckle.

To aid in proper alignment of cap 45 with opening 31 (located in the wall of container 25), protrusions 61, 63 formed in cap 45 (FIG. 3) are made to mate with (i.e. to be inserted into) holes 65, 67 formed in the wall of container 25 (FIG. 2).

As shown in FIG. 3, shaft 47 is provided with roll supporters 69, 71 and plastic sleeve-type hubs 73, 75. Each roll supporter 69, 71 includes a tubular hub portion 77, 79 and a disc or plate portion 81, 83. FIG. 3 also shows shaft 47 to be "D" shaped, having a flat portion 85 disposed along its length. Grooves 87, 89, 91, 93 cut into shaft 47 at selected locations, serve as detent spots along the shaft. As shown in FIG. 4, D-shaped central openings are formed in the hubs 77, 79 (see, e.g. opening 95 in the hub of FIG. 4) by means of a narrow interposer spring 97 which is supported around a portion of its periphery. The central openings in hubs 77, 79 being D-shaped 95, permit the roll supporters 69, 71 (including spring 97) to be easily moved along shaft 47 when the flat portions of the D-shaped openings are in register with the flat portion 85 of shaft 47. However, when a roll supporter 69 or 71 is moved along shaft 47 such that spring 97 encounters a groove 87, 89, 91 or 93, this prevents further lateral movement of the roll supporter along the shaft. Upon rotating the roll supporter about the shaft such that spring 97 engages flat portion 85 (and is no longer in a groove), the roll supporter may then be easily moved to another position along shaft 47.

As indicated above and in FIG. 3, each roll supporter 69, 71 includes a disc or plate portion 81, 83. These plates serve to define the boundaries of individual rolls of paper inserted onto shaft 47 by confining (supporting) the edges of the paper, thereby preventing the paper from "spiraling" over said boundaries. The width of the individual rolls of paper may be, for example, four, six, eight, ten or twelve inches. Plastic sleeve-type hubs 73, 75, each attached to (inserted onto) a roll supporter 69, 71 as shown in FIG. 3, serve as sleeve bearings for mating with the core (i.e., the ends of the tubular axis) of a roll of paper, and for supporting said roll on shaft 47.

The flattened portion 62 of the disc 81, 83, being tangent to a radius less than the outer radius of the disc proper, provides when interposed by a projection (FIG. 2) 64 which is disposed along the length of the container 25 inner wall, and which provides a clearance less than that required by the radius of the disc proper) a means of preventing rotation (i.e., to a position whereby spring 97 engages flat portion 85) of roll supporters 69, 71 within the assembled supply enclosure 23. This restrictive action prevents the accidental loss of paper roll boundaries within the enclosure 23 once assembled.

In another embodiment of the invention as shown in FIG. 5A, lid 33 may be opened and closed (raised and lowered) by means of a mechanical camming device such as a wedge 66. In still another embodiment, lid 33 may be raised and lowered by means of a magnetic device such as a solenoid or a pair of magnetically opposed magnets 68 (FIG. 5B).

In another embodiment of the invention, lid 33 may be opened by the force of gravity and closed by various mechanical latching and holding devices such as a slide pin 70 (FIG. 5C).

We claim:

1. Apparatus for dispensing and accumulating a driven web of selected rigidity and width without folding the web, the apparatus comprising:

enclosure means having a chamber defined therein and a shaft disposed in the chamber for storing the web thereon, said enclosure means having an opening of selected width disposed along the length of said enclosure means sufficient to accommodate passage of the web therethrough;

lid means pivotally affixed to the enclosure means and disposed over the opening and along the length of said enclosure means for preventing light from entering the enclosure means; and guide means disposed proximate to the enclosure means for guiding the driven web through said opening and under the lid means, enabling said web to be dispensed from the shaft and be accumulated in the chamber and about said shaft without becoming folded.

2. The apparatus as in claim 1 wherein the enclosure means includes a first cap portion disposed at one end of the chamber, and a second cap portion removeably disposed at the other end of the chamber and attached to the shaft.

3. The apparatus as in claim 2 wherein the shaft is D-shaped, having a flat portion and having a rounded peripheral portion with grooves formed thereabout at selected locations, said shaft being disposed for supporting a pair of disc members, each disc member having a D-shaped central opening through which the shaft passes, each disc member being slideably mounted on said shaft for supporting the edges of a roll of paper inserted onto the shaft.

4. The apparatus as in claim 3 wherein each disc member includes a spring means forming a portion of the D-shaped central opening such that when the spring means encounters the flat portion of the shaft the dis member may be moved laterally along the shaft, and when the spring means encounters a groove in the shaft lateral movement of the disc is prevented.

5. The apparatus as in claim 4 wherein each disc member has a flat portion at its periphery, and the enclosure includes an elongated projected portion disposed within said enclosure for engaging the disc member at its rounded peripheral portion to prevent rotation of the disc member.

6. The apparatus as in claim 5 wherein the lid means is spring-loaded.

7. The apparatus as in claim 5 wherein the lid means includes a lid and a mechanical camming means for opening and closing the lid.

8. The apparatus as in claim 5 wherein the lid means includes a lid and a magnetic means for opening and closing the lid.

9. The apparatus as in claim 5 wherein the lid means includes a lid which may be opened by the force of gravity and closed by a mechanical latching means.

10. The apparatus as in claim 7 wherein the mechanical camming means is a wedge.

11. The apparatus as in claim 8 wherein the magnetic means is a solenoid.

12. The apparatus as in claim 8 wherein the magnetic means is a pair of magentically opposed magnets.

13. The apparatus as in claim 9 wherein the mechanical latching means is a slide pin.

* * * * *